United States Patent [19]

Reppel

[11] Patent Number: 4,684,028

[45] Date of Patent: Aug. 4, 1987

[54] ARRANGEMENT FOR RECORD FILING

[76] Inventor: Paul Reppel, Ölmühler Weg 5, 5883 Kierspe 3-Rönsahl, Fed. Rep. of Germany

[21] Appl. No.: 810,334

[22] PCT Filed: Mar. 29, 1985

[86] PCT No.: PCT/EP85/00137

§ 371 Date: Nov. 27, 1985

§ 102(e) Date: Nov. 27, 1985

[87] PCT Pub. No.: WO85/04374

PCT Pub. Date: Oct. 10, 1985

[30] Foreign Application Priority Data

Mar. 29, 1984 [DE] Fed. Rep. of Germany ..... 3411543
Sep. 20, 1984 [DE] Fed. Rep. of Germany ..... 3434485

[51] Int. Cl.[4] ..... A47F 7/00

[52] U.S. Cl. ..... 211/51; 211/50; 211/54.1; 248/452

[58] Field of Search ..... 211/51, 50, 54.1; 402/60, 68, 75; 248/452

[56] References Cited

U.S. PATENT DOCUMENTS 662,518 11/1900 Barrett ..... 402/68 X
739,332 9/1903 Melzer ..... 402/75 X
785,911 3/1905 Nold ..... 402/68 X
1,149,086 8/1915 Rittenhouse ..... 402/68 X
1,157,229 10/1915 Klein ..... 402/75 X
1,469,388 10/1923 McBee ..... 402/68 X
1,744,912 1/1930 McBee ..... 211/51 X
2,927,698 3/1960 Fernly ..... 211/51

FOREIGN PATENT DOCUMENTS 313237 2/1974 Austria .
1455843 3/1965 France ..... 402/75

*Primary Examiner*—Ramon S. Britts
*Assistant Examiner*—Blair Johnson
*Attorney, Agent, or Firm*—Mason, Kolehmainen, Rathburn & Wyss

[57] ABSTRACT

An arrangement for filing records in which a fastener, provided with two flexible fastening prongs passing through holes in the records, is maintained in a slot on a fastener carrier, whereby a guide channel located inside the wall of a slot and parallel to the fastener plane, is provided to accommodate the central bead of the fastener and also the openings for the passage of fastening prongs which extend through to reach the bearing surface of the fastener carrier. The technical problems in this case are to configure the filing arrangement so that changing the fastener does not require it to be removed from the fastener carrier itself, and to allow the fastener to be firmly secured without the help of any additional accessories. A flexible flap (12) is arranged opposite the guide channel (9)—see FIG. 1.

8 Claims, 8 Drawing Figures

ARRANGEMENT FOR RECORD FILING

TECHNICAL FIELD OF THE INVENTION

This invention concerns an arrangement for fastening documentary records in file form, consisting of a fastener retained in a single slot of a fastener carrier by means of two prong fasteners which are inserted through holes in the documents and bent over, whereby a longitudinal guide channel is provided along the entire length of the wall of the slot and parallel to the plane of the fastener carrier, which guide channel accomodates a central bead on the fastener, whereby the slot itself also takes the form of openings for the prong fasteners which reach all the way through as far as the bearing surface of the fastener carrier.

BACKGROUND ART

Arrangements for filing documentary records usually take the form of binders or files. If a file fastener is employed, it is usually inserted in either slots and/or channels. In any case, arrangements of this type usually require the use of a flexible fastener carrier.

A filing arrangement of the above type is known from document AT-PS No. 313,237. The fastener with the fastening prongs is retained in a guide channel of a slide which can be inserted in the fastener carrier. To replace the fastener or to remove the stack of document files from the fastener, this slide has to be removed from the fastener carrier. For this purpose, sufficient space must be available within the width of the fastener carrier and in its immediate proximity. However, sufficient clearance is not always available. Since the slide is not secured against movement, it may be accidentally moved inside the fastener carrier and even become separated from it.

DESCRIPTION OF THE INVENTION

The purpose of this invention is to provide an arrangement for filing records, whereby the fastener itself can be moved and removed within the area of the fastener carrier surface but is secured in place without the help of any further accessories.

This requirement is met in the present invention by providing a flexible flap on the fastener carrier surface opposite the slide channel.

The record filing system according to the present invention differs from state-of-the-art devices in a way which is not obvious, in that the fastener is located on the fixed and rigid fastener carrier where it is secured in position by a flap in a slack state. The fastener becomes accessible and can be removed by pressing down on the flap, thus allowing the complete stack of documents in the file, complete with the fastener, to be moved away to the central files. With this system it is possible to work on the files or update them etc., while the working surface is fastened to the fastener carrier. The fastener carrier can be used for removing frequently needed records from the file and can be stored in an office filing cabinet or elsewhere. This arrangement is particularly suitable for filing bank vouchers and statements, all types of lists well as for any other type of record. The size of the fastener carrier and the arrangement of the fastener or fasteners is designed to match the dimensions of the records themselves.

So as to insure easy insertion and positive guidance of the fasteners, offset wall sections are provided on both sides of the guide channel, according to the present invention. This arrangement helps to simplify the design of the die cast tooling shell used to manufacture the molding, since only a single wall section has to be formed on each side of the slot.

A symmetrical arrangement which facilitates insertion of the central bead of the fastener into the guide channel is characterized in that this slot comprises a lower central widened wall section and two upper lateral wall sections. Clearance is left for insertion of the fastener by limiting the vertical overlap of the flap to the edge of the guide channel next to the guide channel referred to above.

After insertion, the fastener is secured in place by means of lateral protrusions provided on the flap, which extend the wall sections of the guide channel. To allow records of different formats to be attached to the fastener, according to this invention, a row of several guide channels is provided along one side of the fastener carrier, whose openings are arranged at equal distances from one another. Provision of these openings allows the fastener to be used in a number of different ways, since the fasteners can be inserted in various ways in adjacent openings on the fastener carrier. This allows the fastener carrier to be put to an extremely wide number of different uses. For example, whole pages and half pages can be filed together, since four openings are provided at equal distances from one another, thus allowing the outer pair of openings or alternatively the inner pair of openings to be used, as required. If the openings are located at the standard 80 mm hole centers, DIN A4 documents can be filed using the central pair of openings. Alternatively, if both of the outer pairs of openings are used, two DIN A5 format (half-page) files can be filed on a single fastener carrier. The distances between the openings can naturally be set to suit other formats, for example, if there is a need to file EDP documents.

In order to secure and keep documents flat, hangar lugs are provided on the fastener carrier, on which a flexible strip is located parallel to the fastener itself.

BRIEF DESCRIPTION OF THE DRAWINGS

One embodiment of the invention is elucidated below with the help of the attached drawings, where.

PREFERRED EMBODIMENTS

Figure 5:
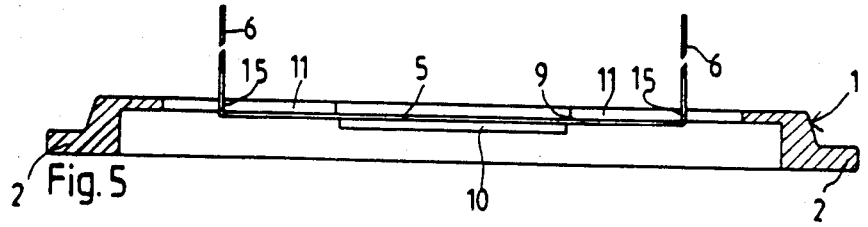
FIG. 5 shows a sectional view along the line V—V in FIG. 4.

The filing arrangement according to this invention comprises a fastener carrier 1, which is an essentially rigid component. A suitable arrangement is for the entire fastener carrier unit 1 to consist of a plastic molding. On both sides of the fastener carrier 1 guide strips 2 are provided which fit on the guide rails of an office filing cabinet or similar arrangement. In this way, the entire fastener carrier 1 can be fitted in a filing cabinet or similar hanging file frame. A grip strip 3 is located on the leading edge of the fastener carrier. A slot 4 is formed on the fastener carrier 1, parallel to the grip strip 3, and the fastener is arranged parallel to the slot 4. The fastener is provided with a central bead 5 and two fastening prongs 6, bent over at a right angle to the fastener, inserted in holes in the document file 7 in the usual way and secured by means of a compressor 8. The guide strips may also be arranged parallel to the fastener carrier, if required. The size of the fastener carrier 1 will be a function of the format of the file documents.

A guide channel 9 is arranged inside the wall of a slot, parallel to the surface of the fastener carrier, whereby the central bead 5 of the fastener is accomodated in the guide channel. This guide channel is delimited by a lower central wider wall section 10 and two upper adjacent lateral wall sections 11. The wall sections 10 and 11 are offset with respect to one another so that the guide channel 9 is only limited on one side at any time. This is an advantage during manufacture, as it allows simple shell mold tooling to be employed. Adoption of such an arrangement also helps to simpliy insertion of the fastener, since the strip is only guided on one side and cannot thus become jammed or tilted inside the guide channel 9. Wall section 10 is widened and projects over the guide channel so as to provide a support for the central bead 5 of the fastener during assembly.

The flexible flap 12 of the fastener carrier 1 is located opposite the guide channel 9. The leading edge of the flap 12 is delimited by the guide channel 9 and also by the slot 13 adjacent to said guide channel at 13 in such a way that one side of the flap 12 is attached to the fastener carrier 1 whereas the remaining part of the flap can be freely bent. An opening 19, which corresponds to the wall section 10, is cut in the flap. The flexible flap 12 is provided with projections 14 adjacent to the guide channel at 9, located along a line extending from the guide channel 9 and which effectively close the latter when the flap is in its slack state. Between the wall section 12 and the projections, openings 15 remain free through which the prongs 6 of the fastener project upwards.

A bead 18 is located on the lower side of the flap 12 and serves to limit movement of the flap 12.

On the side of the fastener carrier facing the fastener, hangar lugs 16 are formed on which a flexible, preferably rubber band 17, can be suspended. Thus, the flexible band 17 will run parallel to the fastener and will stretch right across the stack of documents in the file.

Figure 1:
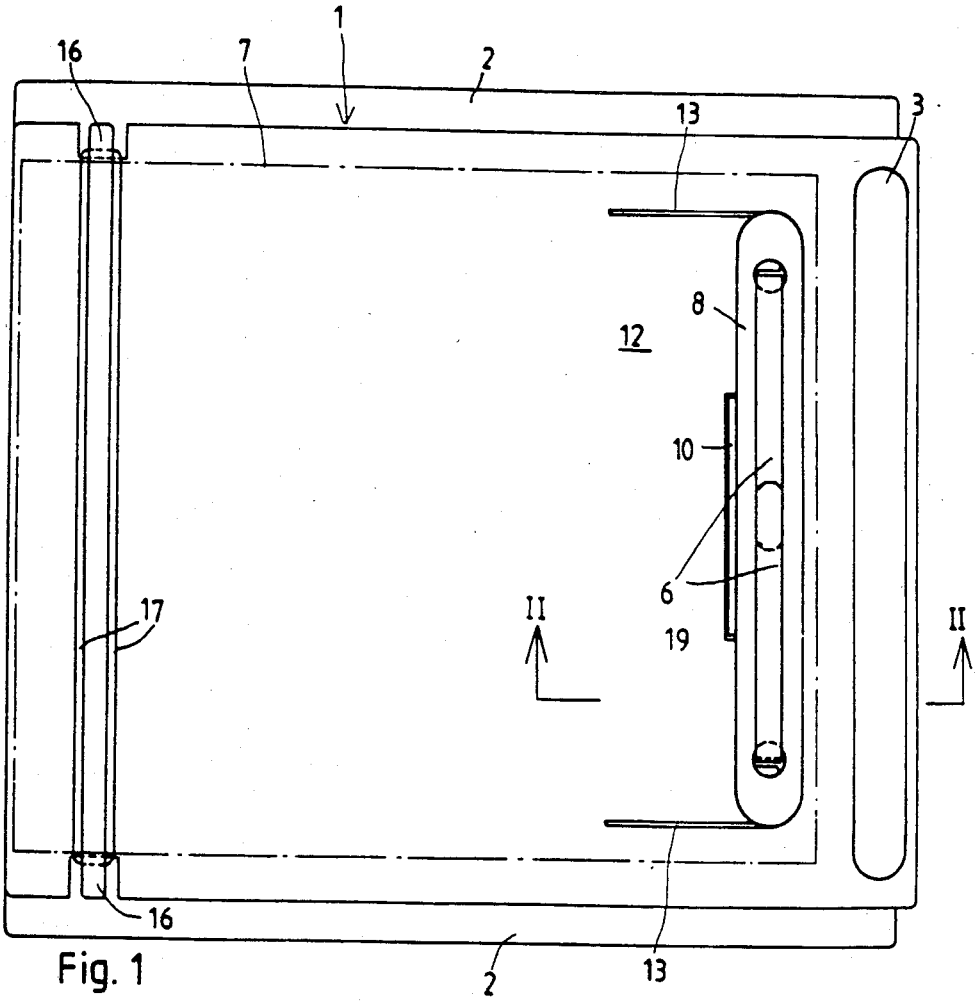
FIG. 1 shows a plan view of a filing arrangement.

FIGS. 1. and 2 show the filing arrangement in use. The central bead 5 of the fastener is located within the guide channel 9 and is delimited by the wall sections 10 and 11 in turn. The fastening prongs 6 extend upwards through the openings 15. The flap 12 is in its slack state and it obstructs the guide channel 9 as well as the openings 15, so that the central bead 5 of the fastener is firmly located. A stack of records 7 can be threaded over the prongs 6 of the fastener and filed in the usual way. The flexible band 17 can be stretched over the ends of the documents in the file in the usual way and thus serve to keep the file of documents 7 together.

Figure 2:
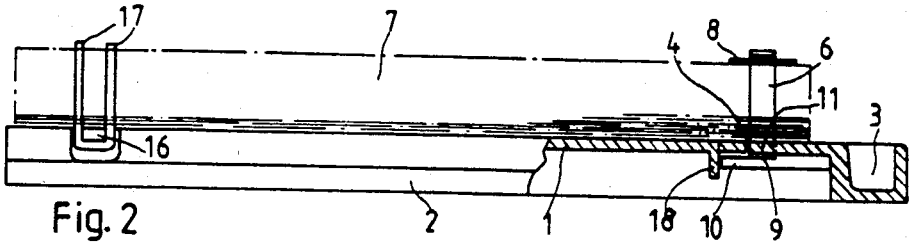
FIG. 2 shows a partial sectional view corresponding to FIG. 1, along aline II—II.
Figure 4:
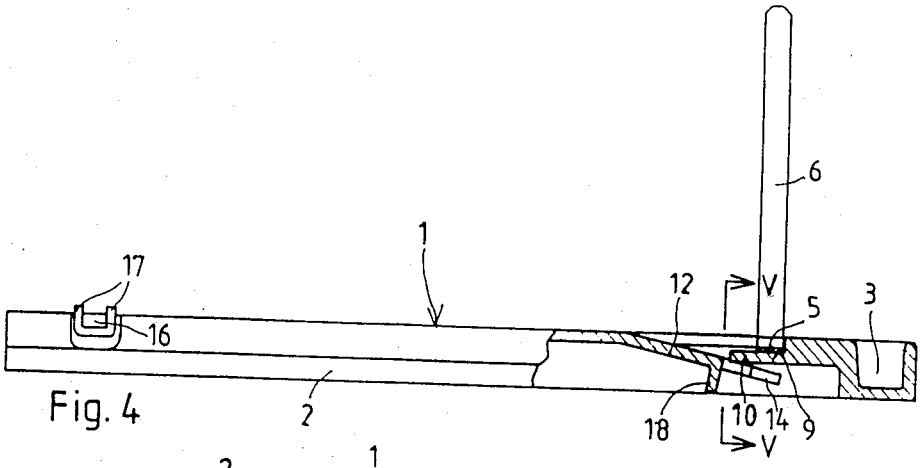
FIG. 4 shows a partial sectional view corresponding to FIG. 3, along a line IV—IV.
Figure 3:
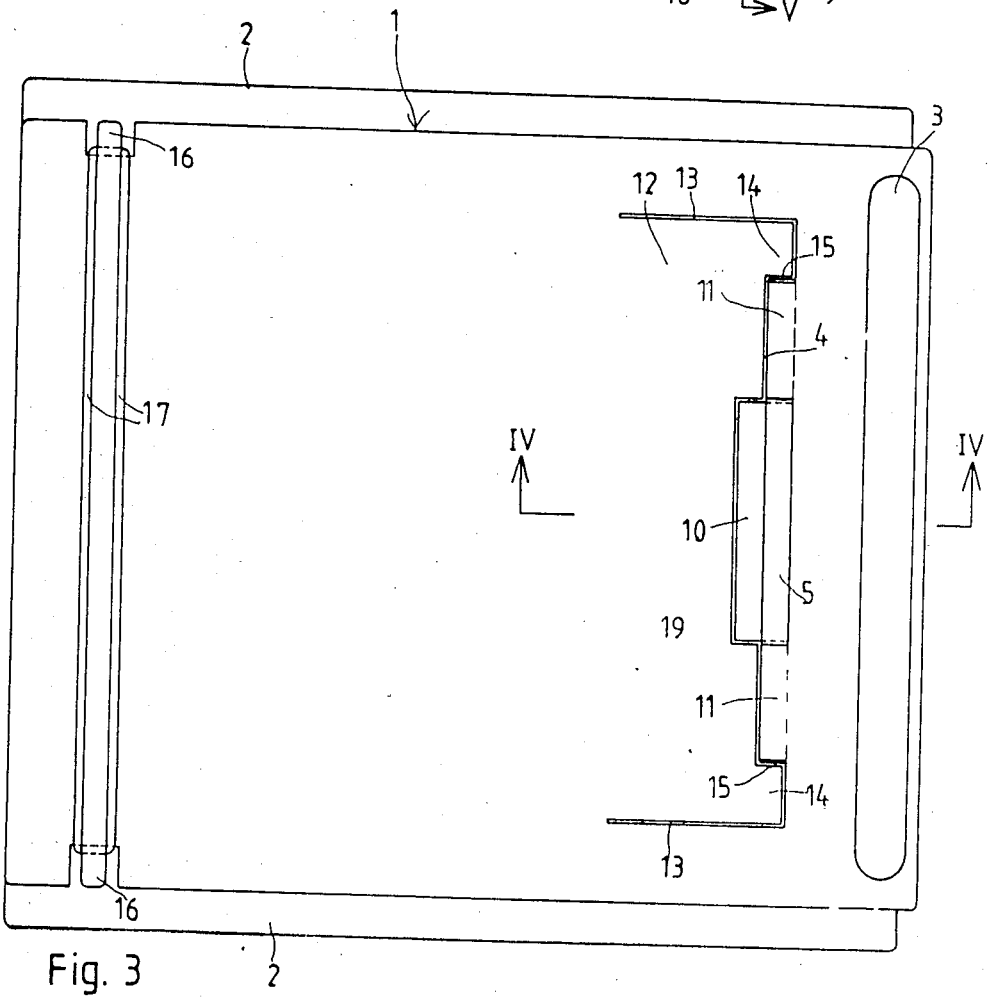
FIG. 3 shows a plan view of the filing arrangement, showing the the file fastening prongs in a erect position.

FIGS. 3 and 4 show the fastener in the assembly position. Flap 12 is pressed down to make the guide channel 9 easily accessible. The fastener is easily inserted in the guide channel by first of all positioning the central bead 5 of the fastener on the projecting wall section 10, after which the bead is pushed sideways under the wall sections 11. This forces the fastening prongs 6 to be inserted in the openings 15. The flap 12 is supported on the bead 18 as it is pressed down and excessive deformation of the flap is thereby prevented. After the fastener has been inserted, flap 12 is released and allowed to recover the slack position shown in FIGS. 1 and 2. The fastener is maintained in position in this way. While the flap 12 is slack, the fastener is unable to slide out of the guide channel 9.

Daily filing is easily carried out on the fastener carrier 1. The fastener carrier can be suspended in a filing cabinet at any time for storage purposes. When the fastener is full, together with the stack of documents in the file it can be removed from the fastener carrier 1 by simply pressing flap 12 downwards, for removal to the permanent files or the file store. The filed documents remain attached to the fastener the whole time and are kept in proper order in this way. A new empty fastener can now be inserted in the fastener carrier which is then ready to accomodate a new file.

Figure 8:
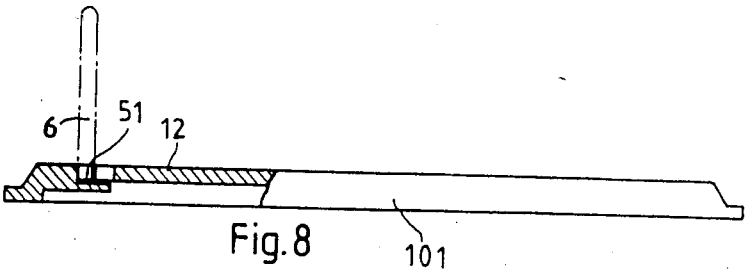
FIG. 8 shows a partial section along the line VIII in FIG. 6.
Figure 7:
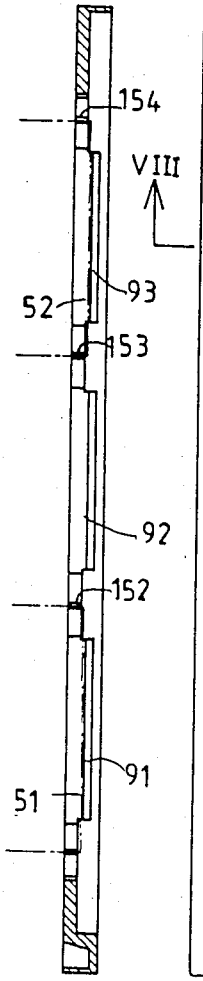
FIG. 7 shows a sectional view along the line VII—VII in FIG. 6.
Figure 6:
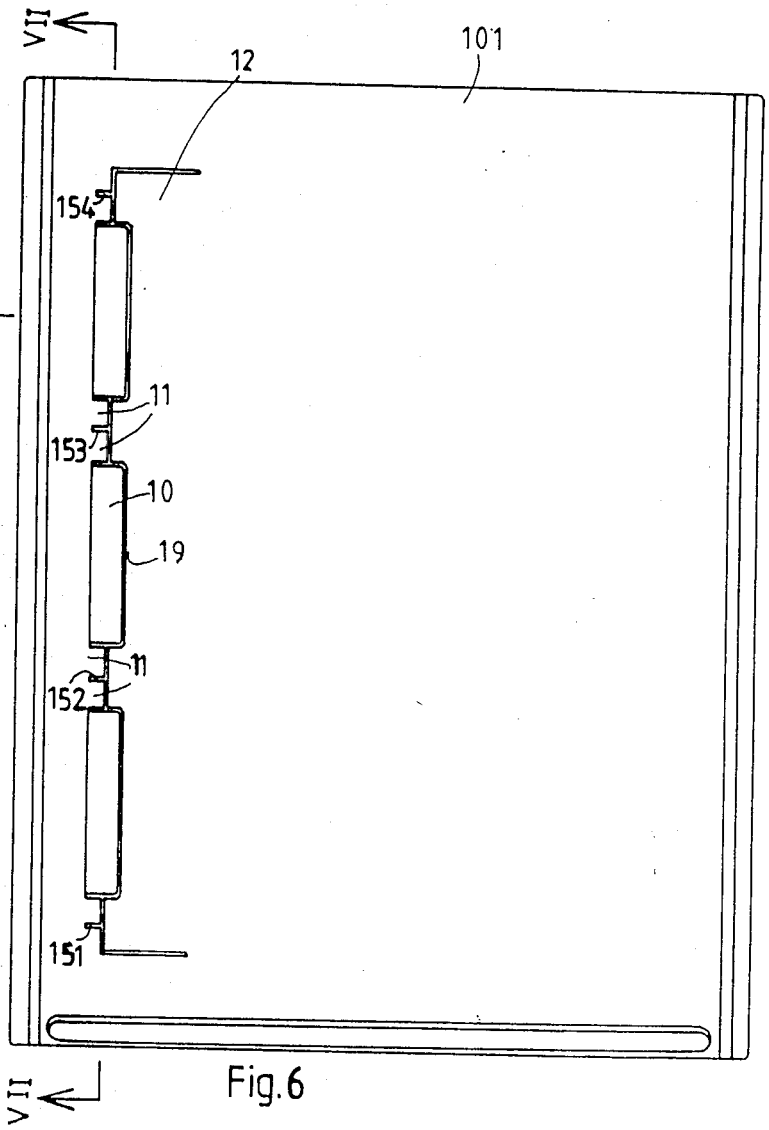
FIG. 6 shows a plan view of a variant of the invention.

In the embodiment of this invention illustrated in FIGS. 6–8, the carrier 101 is designed for records of DIN A4 format. On one side of the carrier 101, three guide channels are formed next to one another and four openings 151, 152, 153 and 154 are provided. Openings 151 and 152 are associated with channel 91, openings 152 and 153 are associated with channel 92 and openings 153 and 154 are associated with channel 93. In this way two guide channels are available for both openings 152 and 153. All guide channels 91, 92 and 93 share a common flap 12. These openings are arranged at a distance of 80 mm from one another, corresponding to the standard hole centers for office filing systems.

The function of the flap 12 and insertion of the fasteners correspond exactly to the embodiment described previously. However, this version of the design allows the system to be employed in a number of different ways. The central pair of openings 152 and 153 can be used to accommodate a single fastener for filing A4 format records. Alternatively, both the outside pairs of openings 151, 152, 153 and 154 can be provided with fasteners 51 and 52. With this arrangement, one DIN A5 format record can be filed on each fastener. In this way, the fastener carrier 101 can provide a multiformat filing arrangement.

The intervals between the openings can of course be arranged to match other hole centers, such as those required for filing EDP documents, for example.

I claim:

1. An arrangement for filing records in which a fastener, provided with a central bead and two flexible fastening prongs for passing through holes in the records, is removably secured in a slot on a fastener carrier said carrier having a generally planar surface for receiving the records and having peripheral edges, whereby a guide channel located within the slot and parallel to the longitudinal axis of the fastener receives the central bead of the fastener, said carrier further comprising a flexible flap formed from a portion of said generally planar surface, is an edge of said flap being disposed adjacent to the guide channel and within said peripheral edges, thereby cooperating with said guide channel and allowing insertion and removal of said fastener from said carrier.

2. A filing arrangement according to claim 1, characterized in that alternating wall sections are provided on both sides of the guide channel.

3. A filing arrangement according to claim 2, characterized in that the guide channel is provided with a lower, central and wider wall section and two upper lateral wall sections which alternate with one another.

4. A filing arrangement according to claim 1, characterized in that the flap is delimited by an adjacent channel which runs at a right angle to the said slot.

5. A filing arrangement according to claim 4, characterized in that the flap is provided with lateral projections which extend the wall sections of the guide channel.

6. A filing arrangement according to any claim 1 characterized in that a number of guide channels are arranged in a row along one side of the fastener carrier, whereby the openings in the guide channels are equidistant from one another.

7. A filing arrangement according to claim 6, characterized in that four equidistant openings in the guide channels are provided so that both the outer pairs, or alternatively, the inner pair of openings can be employed to match the file format, as required.

8. A filing arrangement according to claim 1, characterized in that the fastener carrier is provided with hanger lugs to accommodate a flexible band parallel to the fastener strip.

* * * * *